United States Patent [19]

Martin

[11] 4,148,092

[45] Apr. 3, 1979

[54] ELECTRONIC COMBINATION DOOR LOCK WITH DEAD BOLT SENSING MEANS

[76] Inventor: Ricky Martin, 1851 Pitcairn Dr., Costa Mesa, Calif. 92626

[21] Appl. No.: 821,733

[22] Filed: Aug. 4, 1977

[51] Int. Cl.[2] ..... E05B 49/00

[52] U.S. Cl. ..... 361/172; 70/149; 70/153

[58] Field of Search ..... 361/170, 171, 172; 70/149, 153, 278; 340/149 R, 147 MD; 361/187

[56] References Cited

U.S. PATENT DOCUMENTS

| | | | |
|---|---|---|---|
| 1,573,802 | 2/1926 | Cadenel | 70/278 |
| 3,733,861 | 5/1973 | Lester | 70/153 |
| 3,747,377 | 1/1973 | Van Deudekom | 70/149 |
| 3,796,889 | 3/1974 | Fradkin | 361/172 |
| 3,831,065 | 8/1974 | Martin et al. | 361/172 |
| 3,845,361 | 10/1974 | Watase et al. | 361/172 |
| 4,019,355 | 4/1977 | Germanton | 361/172 |
| 4,038,846 | 8/1977 | Klann | 361/172 |
| 4,062,056 | 12/1977 | Goodrich | 361/172 |

*Primary Examiner*—Gerald Goldberg
*Attorney, Agent, or Firm*—Ralph B. Pastoriza

[57] ABSTRACT

The electronic combination door lock uses a push button keyboard in combination with a door provided with a dead bolt manually operable by an outer turning knob. The electronic circuitry for the keyboard compares an input code with a stored code and generates an enabling signal only if the input code is the same as the stored code. The outer turning knob is restrained from being manually moved to retract the dead bolt when the door is in its locked condition. This restraining of the outer knob is removed by the enabling signal which requires very little energy so that the dead bolt can then be manually retracted. Since the major portion of the work involved in unlocking the door is in a manual operation, very little electrical energy is required for the keyboard and circuitry and a battery can thus be used to thereby eliminate complicated wiring to exterior power sources. Further major features of the invention include the ability to store several different combinations and to reprogram or change such combinations by means of the keyboard itself. The combination itself can comprise any number of digits within the capacity of memory storages in the electronic circuit.

17 Claims, 4 Drawing Figures

ELECTRONIC COMBINATION DOOR LOCK WITH DEAD BOLT SENSING MEANS

This invention relates generally to electronic push button type combination locks for doors and more particularly to an improved electronic combination battery operated door lock for use in apartments and residential homes.

BACKGROUND OF THE INVENTION

In my U.S. Pat. No. 3,831,065 issued Aug. 20, 1974 and entitled ELECTRONIC PUSH BUTTON COMBINATION LOCK, there is disclosed a push button keyboard and associated circuit for installation in commercial establishments such as hotels, motels and the like. The locks as described in this United States Patent are wired to a central desk or office in the hotel or motel at which point various different combinations can be programmed into the locks by the hotel desk manager or other personnel thereby providing an assigned room a combination which may be selected by the customer. A primary purpose of such a system is to avoid the problem associated with lost hotel and motel keys.

The circuit claimed and disclosed in my prior above identified United States Patent utilizes a ring counter having a number of stages one greater than the number of coded digits so that successive comparison of the keyboard input code can be made with the stored codes, the one extra or last stage providing an unlocking signal.

While the foregoing circuit works well for its particular application in hotels and motels and includes the very important feature of permitting a combination to be programmed into any particular locking circuit for any particular room from a central office location, it is not well suited for apartments or residential use. In this respect, a primary difficulty resides in the necessity of wired connections to the lock to provide the necessary energy for electrically throwing the locking bolt. Batteries, of course, could be used but their energy would be drained relatively quickly following several unlocking and locking operations. Also, since wiring must be used to connect the locks to the central office, thus necessitating expensive installation operations in any event, there is no need to use battery power in my foregoing system.

In the case of providing push button electronic combination locks for apartments or residences, various problems arise. First, such a lock must be capable of simple and inexpensive installation with minimum alterations to the premises. This requirement itself forecloses the use of any type of electronic push button combination lock which requires wiring to remote electrical power sources or even around marginal portions of the door or door frame itself. Second, any push button or electronic combination lock for use in apartments or residences should desirably have the capability of storing more than one combination so that, for example, in the case of an apartment complex a landlord will have access to all of the apartments by means of a master combination different from the individual tenant's various combinations. Moreover, the tenant of a specific apartment may wish to provide access to another person such as a maid without the maid knowing the tenant's specific combination. In this respect, the lock involved should desirably incorporate circuitry permitting either or both the landlord and tenant to alter or disable the combination of the tenant and maid respectively.

Finally, the electronic lock should be capable of operating with combinations of digits made up by the user ranging from one or more digits. In other words, a lock which is not restricted to the total number of digits making up the combination code would be far more versatile.

BRIEF DESCRIPTION OF THE PRESENT INVENTION

With the foregoing considerations in mind, the present invention contemplates a greatly improved electronic combination door lock incorporating features desirable for apartment and residential use as outlined above while avoiding disadvantages of various prior art known types of combination locks all to the end that for the first time a sensible and practical electronic push button combination lock is made available to private individuals for use in apartments or residences and the like.

Briefly, the electronic combination door lock of this invention can be installed directly in any door provided with a dead bolt manually operable by an outer turning knob. The electronic door lock itself includes an electronic circuit for comparing an input code from an appropriate push button keyboard with a stored code and generating an enabling signal only if the input code is the same as the stored code. Restraining means in turn are provided responsive to the enabling signal to move from a first position locking the outer turning knob from being manually turned to retract the dead bolt, to a second position releasing the outer turning knob so that the turning knob can be manually turned to retract the dead bolt to unlock the door. Batteries are provided for the electronic circuit to provide the enabling signal and operation of the restraining means, manual retraction of the dead bolt avoiding the necessity for expending any battery power to retract the dead bolt so that less battery drain results than would be the case were the bolt electrically retracted.

The foregoing arrangement avoids the necessity of any types of wiring extending around the margins of the door frame or door itself or to any remote source of electrical energy.

The electronic circuit itself further includes appropriate components enabling storing of more than one code so that different persons having combinations corresponding to the different stored codes may have access. Moreover, the circuitry is such that a user can change a combination by simply programming into the circuit a new combination.

Since energy for the circuit is provided by batteries, there is included a battery voltage sensing means responsive to a drop in battery voltage below a given value to position the restraining means, always in its second position, thus permitting manual operation of the dead bolt so that there is no possibility of a person being locked out and unable to enter because of weak or worn-out batteries.

BRIEF DESCRIPTION OF THE DRAWINGS

A better understanding of this invention as well as many further features and advantages thereof will be had by now referring to the accompanying drawings schematically illustrating a preferred embodiment thereof wherein.

DETAILED DESCRIPTION OF THE PREFERRED EMBODIMENT

Figure 1:
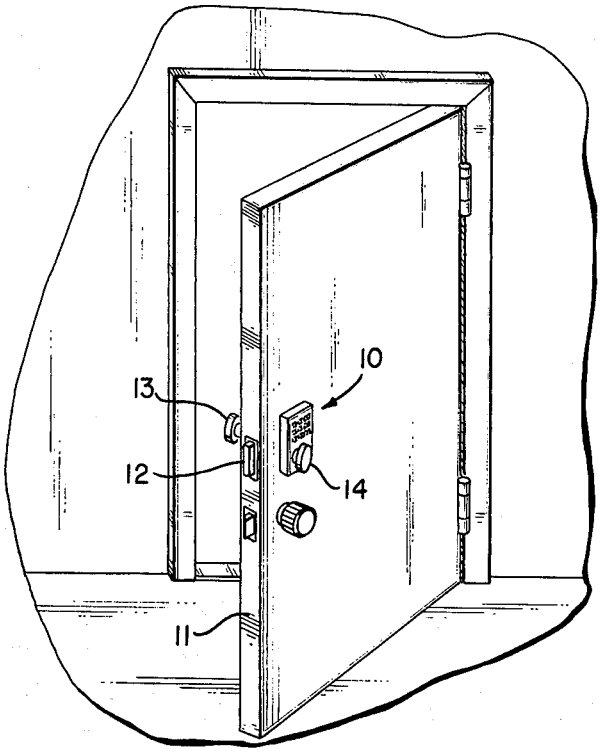
FIG. 1 is a perspective view of an apartment or residential door incorporating the electronic combination door lock of this invention.

Referring first to FIG. 1, there is shown the electronic combination door lock designated generally by the numeral 10 mounted on the outside of a door 11 provided with a dead bolt 12. Inner and outer turning knobs 13 and 14 are shown for manual extension and retraction of the dead bolt 12.

Normally, apartment doors as well as many front doors for residential homes are provided with dead bolts and in such instances, the installation of the electronic combination door lock of this invention is simple and inexpensive as it requires only certain modifications in the dead bolt structure, the appropriate openings in the door itself already being provided. In those instances where the apartment doors or residential doors do not have a dead bolt, installation of the combination lock of this invention merely requires the normal carpentry work to the door that would in any event take place if a dead bolt were to be installed.

Figure 2:
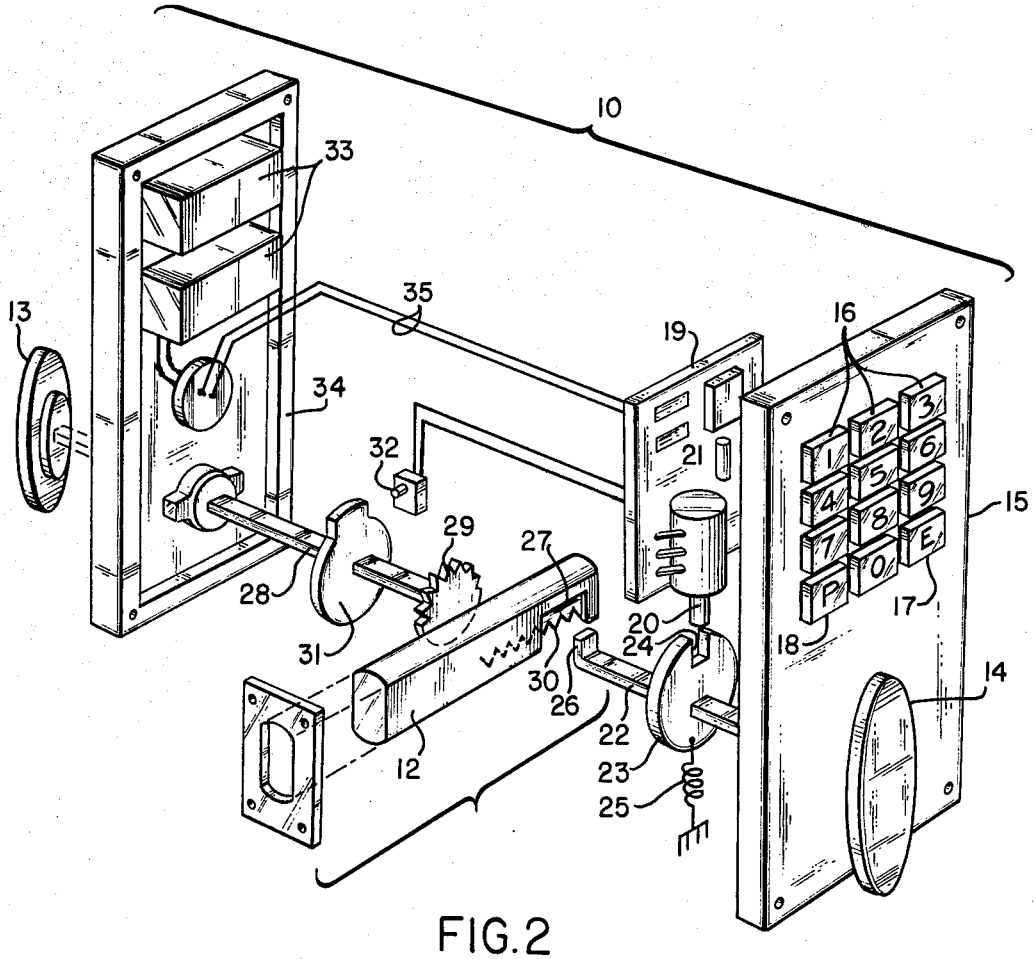
FIG. 2 is an enlarged exploded perspective view illustrating various mechanical components making up the lock used in FIG. 1.

Referring now to FIG. 2, the component parts of the combination door lock of this invention are illustrated in exploded form. Thus, the dead bolt is shown at 12 for manual operation by the inner and outer turning knobs 13 and 14. The mechanical arrangement is such, however, that extending or retracting the bolt 12 by means of the outer turning knob 14 is accomplished by appropriate means coupling the outer turning knob shaft to the dead bolt such that manual movement of the outer turning knob 14 in one direction from a neutral position extends the bolt and manual movement of the outer turning knob in an opposite direction from the neutral position retracts the bolt, the outer turning knob always returning to its neutral position when the bolt is in its extended or retracted position. The inner turning knob 13, on the other hand, is positively coupled to the bolt 12 in such a manner that the bolt can always be extended or retracted by turning the inner turning knob 13 in one direction or the other.

It should be understood from the foregoing, accordingly, that the shaft for the inner turning knob 13 is not connected to the shaft of the outer turning knob 14 but these shafts are rotatable independently of each other, all for purposes of which will become clearer as the description proceeds.

Referring specifically to the lower right hand portion of FIG. 2, there is shown a keyboard 15 having a plurality of manually operable push buttons 16 corresponding to a plurality of different digits. The keyboard 15 is mounted on the door adjacent to the outer turning knob 14 or, may be mounted such that the shaft for the turning knob 14 extends through the lower portion of the keyboard 15 as illustrated.

The keyboard 15 itself in addition to the plurality of push buttons 16 includes an enter key 17 designated E and a program key 18 designated P. The purpose for these particular push buttons will become clearer as the description proceeds.

Shown behind the keyboard 15 is a circuit board 19 containing essentially a micro-processor circuit made up of various components including a keyboard storage means, a master memory containing a stored master code and comparator means connected to the keyboard storage means. The enter key 17 designated E on the keyboard enters into the keyboard storage means a keyboard master code generated by the keyboard by manual operation of the push buttons 16. Operation of this enter key connects the comparator means to the master memory for comparing the keyboard master code to the stored master code, the comparator means generating an enabling signal only if the keyboard master code is the same as the stored master code.

A restraining means is mounted on the circuit board 19 and includes a solenoid plunger 20 operated by a pulse responsive solenoid 21. The outer knob turning shaft is indicated in FIG. 2 at 22 below the solenoid 21 and includes shaft structure 23 defining a cavity 24 for receiving the plunger 20 therein when the turning knob is in its referred to shown neutral position and the plunger 20 is in a first position. This restraining means in the form of the pulse responsive solenoid plunger is responsive to the referred to enabling signal from the comparator means to move to a second position out of the cavity 24 as illustrated in FIG. 2 thereby releasing the shaft to permit manual turning of the shaft by the outer turning knob 14. Essentially, the outer turning knob 14 is released so that the turning knob can be manually turned to retract the dead bolt 12 and unlock the door.

As described heretofore, the outer turning knob 14 always returns to a neutral position corresponding to the position illustrated in FIG. 2. Returning of the knob to this position is accomplished by a spring 25 secured to the shaft structure 23 so as to bias the turning knob 14 back to a neutral position from a rotated position in either direction from the position illustrated.

The turning knob shaft 22 terminates in an upwardly extending finger 26 arranged to effect a lost motion coupling with an undercut channel 27 formed in the rear portion of the dead bolt 12. The manner in which this lost motion coupling enables extension and retraction of the bolt 12 by the turning knob 14 will be described in further detail subsequently.

Shown on the other side of the dead bolt 12 is a shaft 28 for the inner turning knob 13, this shaft 28 terminating in a gear 29. Gear 29 is arranged to couple directly with a gear rack 30 formed on the underside of the bolt 12 so that manual turning of the inner turning knob 13 in one direction or the other will extend and retract the bolt 12 directly. Because of the provision of the lost motion channel 27 in the dead bolt 12 and the fact that the outer turning knob 14 and its shaft are always returned to a neutral position, operation of the dead bolt by the inner turning knob 13 will not move or cause any rotation of the outer knob 14.

It will be recalled from the brief description given thus far that the enabling signal from the comparator means moved the solenoid plunger 20 from a first position restraining movement of the outer turning knob 14, to a second position illustrated in FIG. 2 which releases the shaft structure 23 so that the outer turning knob can be rotated to retract the dead bolt 12. In order that the door will be properly relocked when the dead bolt 12 is extended to its locked position by turning of the outer turning knob 14 in an opposite direction from its neutral position, there is provided a bolt position sensing means passing an appropriate signal to the solenoid 21 to move the plunger 20 back into the cavity 24; that is, to its first position in response to movement of the dead bolt 12 from its retracted to its extended position. This bolt sensing means may take the form of a cam disc 31 mounted for rotation with the inner turning knob shaft 28 and cooperating micro switch 32 positioned to be engaged or released depending upon whether the dead bolt 12 is in its retracted or extended position. This micro switch connects to the circuit board 19 and provides always an indication as to the position of the dead bolt 12.

Still referring to FIG. 2, there are shown battery means 33 mounted within an opposed casing structure 34 and appropriate wire connections from the battery means as by lead 35 to the circuit board 19.

It will be understood that the front edge of the door 11 illustrated in FIG. 1 is sandwiched between the keyboard 15 and the rear casing 34 when all of the components are assembled.

It will further be evident from the description thus far that there are no external wires once the components are assembled passing from the casing structure about the margin of the door or door frame since the entire combination lock is self-contained and energized by the batteries 33.

Most importantly, it is to be recognized that the actual unlocking or locking of the door is effected manually by the outer turning knob 14 or the inner turning knob 13. There is not required any electrical energy from the batteries 33 to electrically retract or extend the dead bolt. Rather, there is only required generation of appropriate pulses passed to the pulse responsive solenoid 21 to move the restraining means in the form of the plunger 20 between its first locking position and second released position relative to the shaft structure 23 for the outer turning knob 14. This represents a very small drain on the batteries 33.

Figure 3:
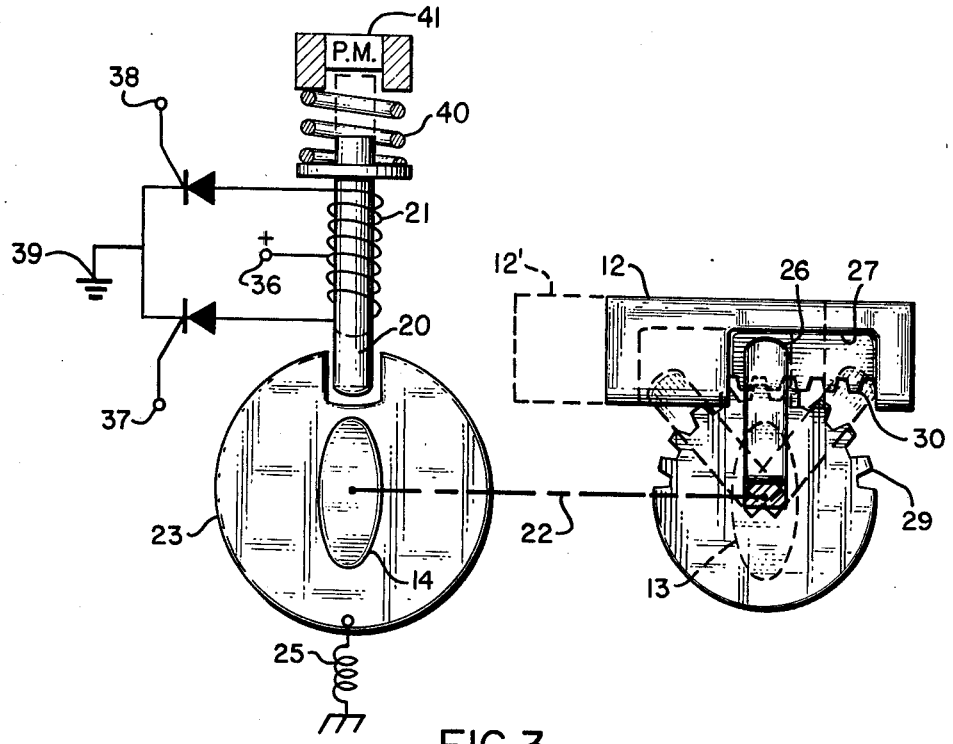
FIG. 3 is a schematic diagram of various components shown in FIG. 2 useful in explaining mechanical operation of the lock; and, FIG. 4 is a schematic block diagram of the basic electronic components making up the combination lock.

Referring now to FIG. 3, the foregoing described operations of the dead bolt will be better understood. As shown, the solenoid plunger 20 is arranged to be moved between its first and second positions by a solenoid winding 21 center tapped at terminal 36 to positive battery voltage. The outer ends of the windings in turn pass through appropriate switches such as SCR's provided with gate terminals 37 and 38 to ground at 39. An electrical pulse on terminal 37 opens the corresponding SCR to pass current from center tap 36 through the lower portion of the winding 21 to ground thereby moving the solenoid 20 to its first position wherein it extends into the cavity 24 of the shaft structure 23 and wherein it will remain, being held in this position by an appropriate biasing spring 40 shown on the upper portion of the plunger 20.

A pulse received on the gate terminal 38 for the other SCR will result in a current flowing through the upper portion of the winding 21 to raise the plunger 20 against the bias of the spring 40.

It will be noted that there is provided a permanent magnet 41 which captures the plunger 20 when moved to its second position and will hold it against the bias of spring 40 even though the pulse on gate terminal 38 has ceased. When a pulse is again received on terminal 37 to energize the lower portion of the winding 21, there is sufficient magnetic field developed to break the holding power of the permanent magnet 41 and the spring 40 thus aids in moving the plunger 20 to its first noted position.

Pulse responsive solenoids such as described are known in the art and per se do not constitute part of this invention. On the other hand, their use as a part of the overall combination is desirable in that the plunger 20 can be positioned in either its first or second position and retained in such position without the necessity of continuous electrical power.

The shaft 22 for the outer turning knob 14 is schematically depicted by the heavy dashed line 22 in FIG. 3 and terminates in the finger 26 described in conjunction with FIG. 2. The manner in which this finger 26 cooperates with the channel 27 in the bolt 12 will be evident, rotation of the turning knob in a counterclockwise direction when the plunger 20 is in its upper or second position to release the shaft structure 23 moving the finger 26 to the dotted line position depicted in FIG. 3 and thus extending the bolt 12 to the dotted line position 12'. The bolt 12 will stay in the dotted line position 12' even though the finger 26 is returned to its upright or neutral position as by the spring 25 illustrated in both FIGS. 2 and 3.

Retraction of the bolt 12 from its extended dotted line position is accomplished by simply turning the outer turning knob 14 in a clockwise direction to the dotted line position illustrated thereby moving the bolt to its solid line position, the finger 26 again returning to its neutral position.

Actuation of the bolt 12 by the inner turning knob in turn is accomplished, as described in conjunction with FIG. 2, by the gear 29 meshing with the rack or gear portion 30 formed on the underside of the bolt 12.

The importance of the bolt sensing means in the form of the cam disc 31 and micro switch 32 described in FIG. 2 can now be appreciated. Thus, once the correct combination is inserted in the lock to provide the enabling signal to the restraining means in the form of the solenoid 21 and plunger 20, movement of the plunger 20 to its upper position depicted in dotted lines in FIG. 3 to release the turning knob 14 permits the knob 14 to be turned in a clockwise direction to retract the bolt 12 from the dotted line position 12' or locked position depicted in FIG. 3 to the solid line or retracted position, the turning knob 14, as stated, returning to its neutral position. However, the plunger 20 is retained in its second or released position by the permanent magnet 41 and will not be re-inserted in the cavity 24 until such time as the restraining means is again triggered. Accordingly, when a person leaves the room and wishes to relock the lock, the bolt sensing means will detect the change in position of the bolt 12 from its solid line retracted position to its dotted line extended position illustrated in FIG. 3 and provide an appropriate signal to the solenoid to move the plunger 20 to its first solid line position illustrated in FIG. 3 thereby locking the outer turning knob against rotation. The door cannot then again be re-entered from the outside without applying the correct combination.

Figure 4:
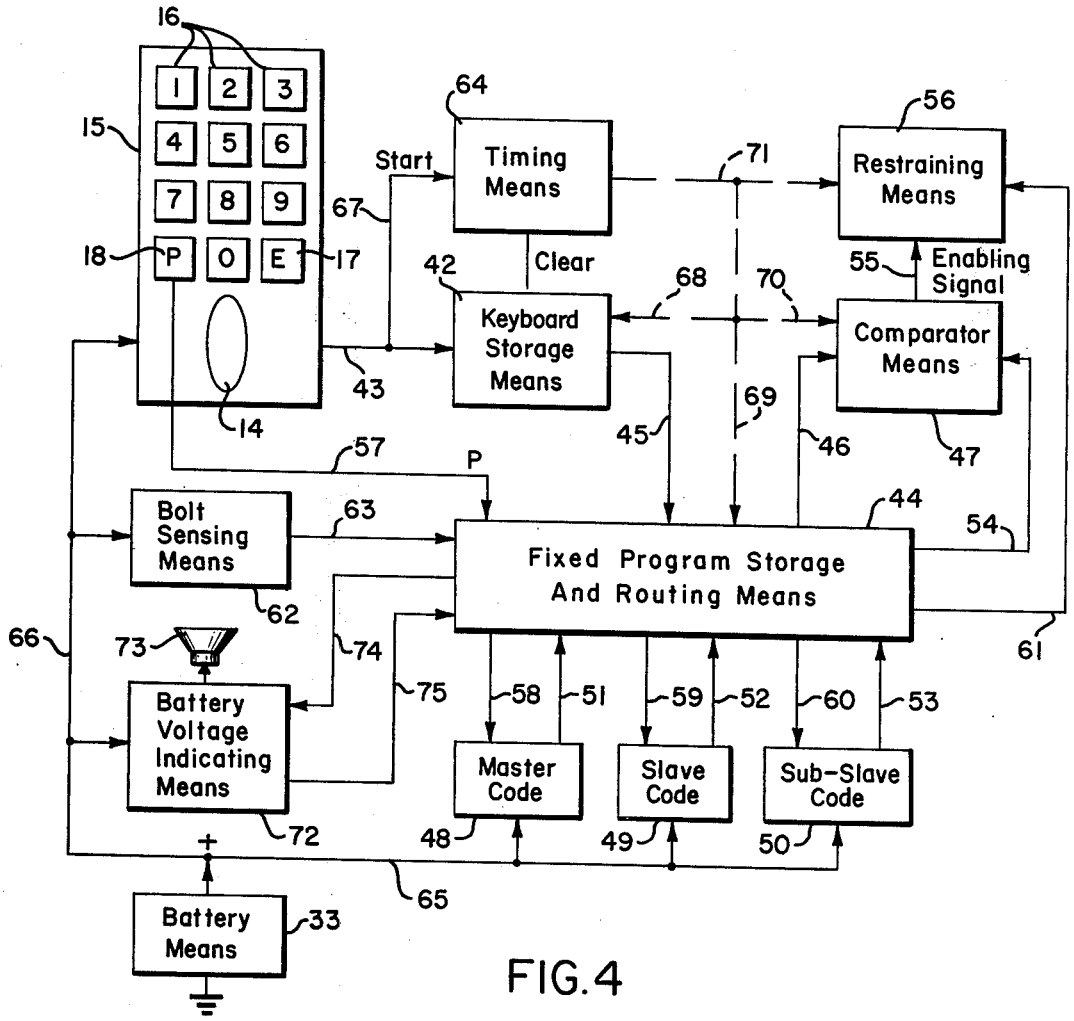

Referring now to FIG. 4, the manner in which all of the foregoing operations are electronically carried out by this invention as well as the manner in which various further important features are realized will be described.

Referring to the left upper portion of FIG. 4, the keyboard 15 with its associated push buttons 16, enter key 17 and programming key 18 together with the turning knob 14 have been reproduced. The keyboard storage means referred to as part of the micro-processor circuit on the circuit board 19 of FIG. 2 is shown by the block 42 connected to the keyboard 15 as by line 43. As also described, this keyboard storage means functions as a buffer to store various digits resulting from manual operation of the push buttons 16 corresponding to a given keyboard code in response to operation of the enter key 17 following the last digit of the keyboard code.

Incorporated in the preferred embodiment of this invention within the micro-processor circuit is a fixed program storage and routing means designated by the block 44. This means serves to effect various connections and disconnections in accord with certain programs between components in the circuit. Thus, the stored given keyboard code in the keyboard storage means is arranged to be connected by way of lead 45 passing into the routing means 44 and lead 46 passing from the routing means 44 to the heretofore referred to comparator means indicated by the block 47. As described, the comparator means 47 will compare the stored keyboard code in the keyboard storage means to a stored master code.

Referring to the lower portion of FIG. 4, such a master code is stored in a master code memory 48. In addition, there are set forth for illustrative purposes of the preferred embodiment of this invention, further code storage memory blocks for storing a slave code such as indicated at 49 and a sub-slave code such as indicated at 50. The codes in any one of these memories can be compared with a given keyboard input code by the comparator means 47 by selective connection of the particular stored code to the other side of the comparator means 47. Thus, each of the stored codes are provided with output leads 51, 52 and 53 passing to the fixed program storage and routing means 44 for connection to the comparator means 47 by way of lead 54 in accord with the particular stored code selected.

Assume, for example, that the given input keyboard code manually applied to the keyboard 15 corresponds to the master code in the master memory 48. Upon operation of the enter key 17 of the keyboard 15, the keyboard code from the keyboard storage means is compared by way of the comparator means 47 with the master code in the master memory 48 and if these codes are the same, the heretofore referred to enabling signal is provided from the output of the comparator means 47 on lead 55 to the restraining means indicated by the block 56. It will be recalled that this restraining means constitutes the pulse responsive solenoid and plunger described in FIGS. 2 and 3.

If the keyboard code manually applied to the push buttons 16 corresponds to the code in the slave memory block 49 of FIG. 4, this slave code is routed by means of the fixed program storage and routing means 44 through lead 52 to lead 54 for comparison with the keyboard stored code in the keyboard storage means 42 and again if the codes correspond, an enabling signal is provided on the lead 55.

Similarly, if a sub-slave keyboard code is manually inserted by the keyboard 15 corresponding to the sub-slave code in the sub-slave memory block 50, the comparator means 47 will provide an enabling signal to the restraining means 56.

It will be evident from the foregoing that in the particular embodiment illustrated, three different code combinations having the same number of digits or a different number of digits as desired may be separately stored in the master, slave and sub-slave code memory blocks 48, 49 and 50 respectively. Entry of a corresponding master, slave or sub-slave code on the keyboard 15 automatically connects the corresponding memory code by way of the fixed program storage and routing means 44 to the other side of the comparator means 47 for comparison with the keyboard code stored in the keyboard storage means so that if correspondence exists, an appropriate enabling signal will be generated. The same keyboard and combination lock arrangement is thus responsive to three different combinations.

The foregoing multiple storage of different combinations might be desirable where a landlord wishes to have access to all of the doors in an apartment complex by means of a single combination. Such combination would be stored in the master code memory block 48 of FIG. 4 in each of the individual electronic combination locks for the individual apartments in question. The slave code memory block 49 in turn, would contain a particular code different from the master code and known only to the tenant so that the tenant can gain access to his apartment only but none of the other apartments, the slave code memory block storing a different slave code for each different tenant. Finally, the tenant himself can provide still a different code in the sub-slave code memory block 50 for use by a maid or some other person that the tenant desires to have access to the apartment without knowing the tenant's code.

With the foregoing arrangement, it will become evident that a landlord might wish to change the combination of the tenant's code when the tenant moves out and a new tenant takes over the apartment. Similarly, a tenant himself may wish to change the sub-slave memory code in the event that a maid or friend leaves town and the tenant no longer wishes to provide access for that person. The preferred form of the electronic combination lock of this invention, accordingly, incorporates means permitting changing of the codes and also various further desirable operations as will now be described.

Referring again to the keyboard 15, it will be noted that the program key 18 identified by P connects through line 57 into the fixed program storage and routing means 44. This program key constitutes part of a programming key means which includes the program key and pairs of pre-assigned digits. The first digit in each pair selects a particular operation and the second digit directs the operation to a particular component on which the operation is to take place. Thus the operation of any programming key means constitutes operation of the program key followed by sequential operation of two push buttons corresponding to the first and second pre-assigned digits respectively. The designated program or operation and the particular components to which it is to be directed is controlled by the fixed program storage and routing means which receives this information through the lead 57.

Thus, the fixed program storage and routing means is responsive to first given operations of the programming key means followed by entry of a given keyboard code, to disconnect the comparator means 47 from the keyboard storage means 42 via the fixed program storage and routing means and provide access between the keyboard storage means 42 and the master memory, slave memory and sub-slave memory blocks 48, 49 and 50, depending respectively, upon whether the given keyboard code is the keyboard master code, keyboard slave code or keyboard sub-slave code corresponding to the particular codes in the memories 48, 49 and 50.

With access so provided, it is now possible to insert a new code in the corresponding accessed memory by simply operating the push buttons corresponding to the new code on the keyboard followed by operation of the enter key. The fixed program storage and routing means 44 is responsive to operation of the enter key after the new code has been generated by the keyboard to remove the access and reconnect the comparator means to the keyboard storage means by way of the leads 45 and 46 with the result that any one or more of the originally stored codes can be changed by a person knowing the originally stored code. The access to the various code memories is provided by the leads 58, 59 and 60 as illustrated in FIG. 4 passing from the fixed program storage and routing means to the master memory, slave memory and sub-slave memory blocks 48, 49 and 50 respectively.

In addition to the referred to first given operations of the programming key means, further operations can be carried out. For example, the fixed program storage and routing means is responsive to second given operations of the programming key means following entry of a given keyboard code to enable one or more of the following: first, the stored slave code to be changed when the entered given keyboard code is the keyboard master code; and second, the stored sub-slave code to be changed when the entered given keyboard code is the keyboard slave code.

By means of the foregoing second given operations of the programming key means, a landlord can change his tenant's code or a tenant may change a sub-slave code provided to a maid or friend.

In certain instances, rather than change the tenant's combination code, the landlord may wish to merely inhibit operation of the code; that is, disable the same for a temporary period. Similarly, a tenant may wish to inhibit or disable the sub-slave code for a temporary period. In each instance, the landlord or tenant may wish to restore operation of the tenant's code or sub-slave code respectively without having to go through the process of recoding.

Thus, the fixed program storage and routing means 34 of FIG. 4 is made responsive to third given operations of the programming key means following entry of a given keyboard code to enable one or more of the following: first, the stored slave code to be inhibited or disabled when the entered given keyboard code is the keyboard master code; and second, the stored sub-slave code to be inhibited or disabled when the entered given keyboard code is the keyboard slave code.

Further, the fixed program storage and routing means 44 is made responsive to fourth given operations of the programming key means following entry of a given keyboard code to enable one or more of the following: first, the stored slave code to be uninhibited or again placed into operation when the entered given keyboard code is the keyboard master code, and, second, the stored sub-slave code to be uninhibited or placed in condition for operation when the entered given keyboard code is the keyboard slave code.

The foregoing programming operations provide great versatility to the electronic combination lock of this invention as will be evident.

Finally, there are instances in which it may be desirable to hold the door unlocked at all times. In this case, the fixed program storage and routing means includes an appropriate stored program responsive to fifth given operations of said programming key means following the entry of a given keyboard code, to move the restraining means by way of line 61 in FIG. 4 to its first position locking turning of the outer turning knob when the dead bolt is in its retracted position and also disconnect the comparator means 47 so that the door is unlocked at all times and cannot be locked by means of the outer turning knob.

Similarly, there may be instances in which it is desired to maintain the door locked at all times and towards this end, the fixed program storage and routing means 44 contains yet an additional program responsive to sixth given operations of the programming key means following entry of a given keyboard code, to move the restraining means to its first position only when the dead bolt is in its extended position and to disconnect the comparator means to thereby hold the door locked at all times so that the extended bolt cannot be retracted by the outer turning knob.

As specific examples of each of the first, second, third, fourth, fifth and sixth given operations of the programming key means, the programming codes to provide access to the memory storage blocks to change the combination thereof might be as follows: P11; P12; and P13. In these codes, the pre-assigned digit 1 tells the fixed program storage and routing means that one of the stored combinations is to be changed while the second numeral designates the particular memory which is to be changed. Thus, the second digit 1 might indicate the master code memory 48, the second digit 2 might indicate the slave code memory and the second digit 3 might indicate the sub-slave code memory.

The inhibiting and uninhibiting operations of the various codes might be designated by programming key codes as follows: P22; P23; P32, and P33. In these programming codes the first digit 2 would represent a disabling or inhibiting operation while the second digit 2 and 3 respectively would indicate that it is the slave code or sub-slave code that is to be inhibited.

In the uninhibiting or re-establishment of operation of the memory codes, the first digit 3 would indicate such operation of re-enabling the circuit while the second digit would designate the particular storage memories to be restored.

Finally, a code such as P44 and P45 would serve to control the restraining means by way of the lead 61 described in FIG. 4 to maintain the door unlocked at all times or maintain the door locked at all times respectively, the first digit 4 indicating the operation and the second digit indicating whether the door is to remain unlocked or to remain locked.

With respect to the last foregoing operations, the particular programs are responsive to the bolt sensing means shown by the block 62 in FIG. 4 which provides the fixed program storage and routing means with information as to the actual position of the bolt. In other words, unless the bolt is initially retracted, the program to hold the door unlocked at all times would not be acceptable. It would first be necessary to retract the bolt which would provide an appropriate signal by the bolt position sensing means 62 through the line 63 to the fixed program storage and routing means 44 to thus enable this latter program to take place.

Similarly, the program for maintaining the door unlocked at all times could not be carried out unless the bolt is initially extended and again the bolt position sensing means will provide an appropriate signal along line 63 to indicate this condition and enable this last program to be carried out.

Many other programs of course can be built into the micro-processing circuits of this invention; the foregoing are merely exemplary to indicate the versatility of the electronic combination lock of this invention.

As described heretofore, by utilizing a manual turning knob for actually extending or retracting the dead bolt, drain of battery energy for this purpose is avoided all to the end that it becomes practical and feasible to utilize batteries for energizing the combination lock. In addition, however, to further extend the life of the batteries it is desirable to utilize as little battery energy as possible for the operation of other components of the circuit.

With the above in mind, the circuit shown in FIG. 4 as indicated at the upper center portion includes a timing means 64. This timing means 64 is automatically started in response to a first one of the push buttons 16 depressed on the keyboard 15. Thus, as shown in the lower left of FIG. 4 the battery means 33 provides positive voltage continuously to line 65 which serves to retain the coded memories in the memory blocks 48, 49 and 50 and also to maintain continuous voltage available on the bolt sensing means 62. However, the energy required for these particular components is extremely low and negligible effects are had on draining the battery 33. On the other hand, the remaining components such as the keyboard storage means 42, fixed program stroage and routing means 44, comparator means 47, and restraining means 56 require relatively greater amounts of battery power. The timing means 64 essentially provides power from the battery means 33 to these components only when they are operating. Thus, the output from the battery means 33 extends along lead 66 to the keyboard 15 wherein it is only passed to the starting means 64 by way of lead 67 upon depression of a first one of the operating keys. Triggering of the timing means 64 starts generation of a given time interval and locks power connection from the battery means 33 during this time interval to the various components 42, 44, 47 and 56 by way of connecting leads 68, 69, 70 and 71 respectively. At the end of the timing interval, power is automatically discontinued to these components so that energy is conserved during the long dormant periods that the combination lock is not operated.

It should be understood that the timing means 64 provides additional advantages. Essentially, the given time interval is restarted each time one of the keys on the keyboard 15 is depressed. Assume that the given time interval is, for example, five seconds. If a person does not punch in his combination on the keyboard within five seconds, the door will not be unlocked. Normally, anyone can punch in even a six or seven digit combination code easily within a five second period so that normally the door will be unlocked and access provided. At the end of the five second interval measured from the time of depression of the last key for example the enter key 17, all power to the various major components described is dropped. It will be recalled that the restraining means in the form of the solenoid plunger 20 described in FIG. 3 will stay in either its first position or second position without the benefit of any battery energy because of the characteristics of this solenoid. However, it will be recalled that the bolt sensing means described in FIG. 2 and shown by the block 62 in FIG. 4 is always responsive to a change in position of the dead bolt so that when a person leaves a room and wishes to relock the door, his manual action of extending the bolt by turning the outer turning knob triggers the bolt sensing means to provide energy by way of the fixed program storage and routing means 44 and lead 61 to the restraining means 56 to move the solenoid plunger 20 back to its first position to relock the outer knob. The battery is only required to provide energy during this specific operation and the timing means and other components are not involved.

Finally, in the preferred embodiment of this invention as described to provide for a fail safe situation, it is desirable to have some means for indicating when the battery voltage drops below a given level to provide ample warning that the batteries are wearing down. Moreover, in addition to such warning, the circuit is preferably designed so that the restraining means will always move to its second position releasing the outer turning knob a given period of time after the batteries have dropped below a given voltage level so that a person will not be inadvertently locked out should the batteries completely wear out.

To provide for the foregoing, the circuit of FIG. 4 includes a battery voltage indicating means as shown by the block 72 connected to the branch output lead 66 from the battery 33 and responsive to a drop in the battery voltage below a given level to sound an audio alarm such as a buzzer, schematically indicated by the speaker 73. A user of the combination lock will thus be immediately apprised in response to sound of the buzzer 73 that the batteries are becoming low and should be replaced.

Further, the battery voltage indicating means preferably includes means responsive to a given number of operations of the combination lock as might be supplied through the lead 74 from the fixed program storage and routing means occurring after the first audio signal to generate an appropriate signal such as on lead 75 and by way of lead 61 to the restraining means 56 to assure that it is moved to its second released position.

With the foregoing arrangement, even if a user does not change the batteries upon initial warnings by the buzzer, there is no possibility of his being locked out as a result of complete failure of the batteries.

From all of the foregoing description, it will thus be evident that the present invention has provided a greatly improved electronic combination door lock having various features rendering it particularly useful for private individuals such as landlords in apartment complexes or even individual resident homeowners.

I claim:

1. An electronic combination lock for use with a door including, in combination:

(a) a dead bolt on said door manually operable by an outer turning knob;

(b) an electronic circuit for comparing an input code with a stored code and generating an enabling signal only if said input code is the same as said stored code;

(c) restraining means responsive to said enabling signal to move from a first position locking said outer turning knob from being manually turned to retract said dead bolt, to a second position releasing said outer turning knob so that said outer turning knob can be manually turned to retract said dead bolt to unlock said door;

(d) bolt position sensing means for sensing a change in the position of said bolt, said restraining means being responsive to said bolt position sensing means to return to said first position when said bolt is manually extended by said outer turning knob to lock said outer turning knob from being manulaly turned to retract said dead bolt;

(e) battery means for said electronic circuit to provide said enabling signal and operation of said restraining means, manual retraction of said dead bolt avoiding the necessity for expending any battery power to retract said dead bolt whereby less battery drain results than would be the case were the bolt electrically retracted.

2. The subject matter of claim 1, in which said restraining means includes a pulse responsive solenoid plunger movable between said first and second positions, said outer turning knob having a shaft structure defining a cavity for receiving said plunger therein when said turning knob is in a neutral position and said plunger is in said first position, movement of said plunger to said second position out of said cavity releasing said shaft to permit manual turning of said shaft by said outer turning knob; means biasing said outer turning knob to said neutral position; and means coupling said shaft to said dead bolt such that movement of said outer turning means in one direction from said neutral position retracts said bolt, said knob always returning to its neutral position when said bolt is in its extended or retracted position.

3. The subject matter of claim 1, in which said door is provided with an inner turning knob on the opposite side from said outer turning knob positively coupled to said dead bolt for manual retraction or extension regardless of the position of said restraining means so that said door can always be locked or unlocked from the inside.

4. An electronic combination door lock for use with a door provided with a dead bolt manually operable by inner and outer turning knobs on opposite sides of the door respectively, including:

(a) a keyboard having a plurality of manually operable pushbuttons corresponding to a plurality of different digits on said door adjacent to said outer turning knob;

(b) a keyboard storage means;

(c) an enter key on said keyboard for entering into said keyboard storage means a keyboard master code generated by said keyboard by manual operation of said push buttons;

(d) a master memory containing a stored master code;

(e) comparator means connected to said keyboard storage means, operation of said enter key connecting said comparator means to said master memory for comparing said keyboard master code to said stored master code, said comparator means generating an enabling signal only if said keyboard master code is the same as said stored master code;

(f) restraining means responsive to said enabling signal to move from a first position locking said outer turning knob from turning to retract said dead bolt, to a second position releasing said outer turning knob so that said turning knob can be turned to retract said dead bolt to unlock said door; and (g) bolt position sensing means for sensing a change in the position of said bolt, said restraining means being responsive to said bolt position sensing means to return to said first position when said bolt is manually extended by said outer turning knob to lock said outer turning knob from being manually turned to retract said dead bolt.

5. The subject matter of claim 4, further including a slave memory containing a stored slave code, operation of said enter key to enter a keyboard slave code generated by said keyboard to said keyboard storage means, connecting said comparator means to said slave memory for comparing said keyboard slave code to said stored slave code, said comparator means generating said enabling signal only if said keyboard slave code is the same as said stored slave code.

6. The subject matter of claim 5, further including a sub-slave memory containing a stored sub-slave code, operation of said enter key to enter a keyboard sub-slave code generated by said keyboard to said keyboard storage means, connecting said comparator means to said sub-slave memory for comparing said keyboard sub-slave code to said stored sub-slave code, said comparator means generating said enabling signal only if said keyboard sub-slave code is the same as said stored sub-slave code.

7. The subject matter of claim 6, further including a programming key means on said keyboard; and fixed program storager and routing means responsive to first given operations of said programming key means following entry of a given keyboard code, to disconnect said comparator means from said keyboard storage means and provide access between said keyboard storage means and said master memory, slave memory and sub-slave memory, depending respectively, upon whether said given keyboard code is said keyboard master code, said keyboard slave code or said keyboard sub-slave code, operation of said push buttons and enter key following said first given operations of said programming key means, inserting a new code in the corresponding accessed memory, said routing means being responsive to operation of said enter key after the new code has been generated by said keyboard to remove said access and reconnect said comparator means to said keyboard storage means, whereby any one or more of the originally stored codes can be changed by a person knowing the originally stored code.

8. The subject matter of claim 7, in which said fixed program storage and routing means is responsive to second given operations of said programming key means following entry of said given keyboard code to enable one or more of the following:

(a) the stored slave code to be changed when the entered given keyboard code is said keyboard master code, (b) the stored sub-slave code to be changed when the entered given keyboard code is the keyboard slave code.

9. The subject matter of claim 8, in which said fixed program storage and routing means is responsive to third given operations of said programming key means following entry of said given keyboard code to enable one or more of the following:

(a) the stored slave code to be inhibited from operation when the entered given keyboard code is said keyboard master code;

(b) the stored sub-slave code to be inhibited when the entered given keyboard code is the keyboard slave code.

10. The subject matter of claim 9, in which said fixed program storage and routing means is responsive to fourth given operations of said programming key means following entry of said given keyboard code to enable one or more of the following:

(a) the stored slave code to be uninhibited when the entered given keyboard code is said keyboard master code, (b) te stored sub-slave code to be uninhibited when the entered given keyboard code is the keyboard slave code.

11. The subject matter of claim 10, in which said fixed program storage and routing means is responsive to fifth given operations of said programming key means following entry of a given keyboard code, to move said restraining means to said first position when said dead bolt is in its retracted position and disconnect said comparator means to thereby hold said door unlocked at all times.

12. The subject matter of claim 11, in which said fixed program storage and routing means is responsive to sixth given operations of said programming key means following entry of a given keyboard code, to move said restraining means to said first position when said dead bolt is in its extended position and to disconnect said comparator means to thereby hold said door locked at all times.

13. The subject matter of claim 12, in which said programming key means includes a program key on said keyboard and pairs of pre-assigned digits, the first digit in each pair selecting a particular operation and the second digit directing the operation to a particular component upon which the operation is to take place, the operation of said programming key means constituting operation of said program key followed by a sequential operation of the two push buttons corresponding to said first and second pre-assigned digits respectively, each of said first, second, third, fourth, fifth and sixth given operations of said programming key means being distinguished by different pre-assigned digits making up the pair.

14. The subject matter of claim 4, including timing means disconnecting said comparator means from said master memory and clearing said keyboard storage means of information stored therein after a given time interval.

15. The subject matter of claim 14, including battery means providing continuous electrical power for said master memory and said bolt position sensing means, and further providing electrical power for said keyboard storage means, comparator means and restraining means only during said given time interval established by said timing means.

16. The subject matter of claim 15, including battery voltage indicating means connected to said battery means for sounding an audio signal in response to operation of said combination lock only if said battery voltage is below a given value.

17. The subject matter of claim 16, including means connected to said battery voltage indicating means and to said restraining means for moving said restraining means to said second position only after a given number of audio indications has occurred following the first audio indication that said battery voltage is below said given value.

* * * * *